US006082067A

United States Patent [19]

Bott

[11] Patent Number: 6,082,067

[45] **Date of Patent: *Jul. 4, 2000**

[54] DRY STACKABLE BLOCK STRUCTURES

[75] Inventor: Tim Allen Bott, Sunfish Lake, Minn.

[73] Assignee: Allan Block Corporation, Edina, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/246,230

[22] Filed: Feb. 8, 1999

[51] Int. Cl.[7] ..... E04B 2/46; E04B 2/48

[52] U.S. Cl. ..... 52/592.3; 52/421; 52/592.5; 52/592.6; 52/604; 52/605; 52/607

[58] Field of Search ..... 52/592.5, 592.6, 52/604, 606, 607, 431, 421, 425, 592.3, 589.1, 592.2, 605

[56] References Cited

U.S. PATENT DOCUMENTS

| | | | |
|---|---|---|---|
| 257,155 | 5/1882 | Dupuis | 52/592.6 |
| 2,019,653 | 11/1935 | Buyer | 72/41 |
| 2,484,062 | 10/1949 | Abbott . | |
| 2,688,245 | 9/1954 | Vesper | 72/41 |
| 2,720,104 | 10/1955 | Cameron . | |
| 5,729,943 | 3/1998 | Cambiuzzi | 52/438 |

*Primary Examiner*—Carl D. Friedman
*Assistant Examiner*—Yvonne M. Horton
*Attorney, Agent, or Firm*—Haugen Law Firm PLLP

[57] ABSTRACT

A stackable block structure system for dry stacking concrete reinforced walls which provides for alignment and leveling during construction includes a stretcher block having a recess of triangular cross-sectional configuration formed on a bottom surface and disposed intermediate a pair of co-planar, parallelly disposed laterally extending rectangular edge portions. The top surface of the stretcher block includes a flat portion disposed intermediate a pair of parallelly extending rectangular edge portions the top surfaces of which form upwardly converging surfaces of truncated triangular cross-sectional configuration. Inside sections of the top surface edge portions are configured to matingly and adjustably abut respective outside sections of the bottom surface recess surfaces of a block in an adjacent stacked row. A corner block includes a first portion of generally parallelepiped configuration and an integral second portion of similar configuration to the stretcher block.

2 Claims, 7 Drawing Sheets

54
34
32
55
57
25
58
56
17
59
10
14
28
26
27
35
30
13
12
25
29
25
33
3
3
45
46
31
16
48
47

25
35
16
14
26
33
27
47
48
13
12
51
50
22
21
23
15
46
24
20

DRY STACKABLE BLOCK STRUCTURES

FIELD OF THE INVENTION

The present invention relates to stackable block structures and more particularly pertains to a concrete block stacking system for dry stacking of concrete reinforced walls and which provides for alignment and leveling during construction.

SUMMARY OF THE INVENTION

The concrete block stacking system of this invention comprises a stretcher block structure and a corner block structure. The stretcher block structure is characterized by a pair of opposed rectangular front and rear panels, a top and bottom surface, and a pair of opposed end wall surfaces. The bottom surface is further characterized by a pair of co-planar, parallelly disposed laterally extending rectangular edge portions defining a recess therebetween. The bottom surface recess forms upwardly converging surfaces of triangular cross-sectional configuration.

The top surface is further characterized by a flat portion having a plane parallel to the plane of the bottom surface edge portions. The flat portion is disposed intermediate a pair of parallelly extending rectangular edge portions, the top surfaces of which form upwardly converging surfaces of truncated triangular cross-sectional configuration. Inside sections of the top surface edge portions are configured to matingly and adjustably abut respective outside sections of the bottom surface recess of a block in an adjacent stacked row. The arrangement of stacked stretcher blocks of the present invention thereby provides for transverse as well as longitudinal alignment of the stacked blocks and rows of blocks. Height control is further achieved by the utilization of the non-planar contact surfaces. This is achieved through controllably arcuately rotating superimposed blocks a modest amount in order to achieve controlled height on a row-to-row basis. The arcuate rotation is normally undertaken by having mutually adjacent rows rotated in equal and opposite directions, thereby achieving an appropriate leveling effect. The arcuate rotation is extremely minimal, and may typically involve up to or less than about $1/16^{th}$ inch on the block surfaces. Manufacturing tolerances are facilitated by utilization of this technique as well.

A first end wall surface is further characterized by a recess having a planar portion disposed intermediate a pair of inwardly converging surfaces. The planar portion has a plane perpendicular to the plane of the top surface flat portion. The first end wall recess is further disposed intermediate a pair of co-planar, parallelly disposed laterally extending generally parallelepiped-end portions having a plane perpendicular to the top surface flat portion.

A second end wall surface is further characterized by a protrusion having an concave portion of generally semicircular cross section disposed intermediate a pair of outwardly converging surfaces. The protrusion is further disposed intermediate a pair of co-planar, parallelly disposed laterally extending rectangular end portions having a plane perpendicular to the top surface flat portion. The outwardly converging surfaces of the second end wall are matingly abuttable to the inwardly converging surfaces of the first end wall of an adjacent block in a row. In this manner the block structures of the present invention provide for lateral alignment of the stacked blocks as well as a means for interlocking adjacent blocks.

The block stacking system further includes a block structure specific to corner installation. The corner block structure is characterized by a first portion of parallelepiped construction having a pair of side surfaces, an end surface, a top surface, and a bottom surface. Integrally formed to the first portion is a second portion having a top surface, a bottom surface, an end surface, and a pair of side surfaces. The side surfaces of the second portion are co-planar with the side surfaces of the first portion.

The bottom surface of the second portion is of similar configuration as the bottom surface of the stretcher block and is characterized by a pair of co-planar, parallelly disposed laterally extending rectangular edge portions defining a recess therebetween. The bottom surface recess forms upwardly converging surfaces of triangular cross-sectional configuration.

The top surface of the second portion is of similar configuration as the top surface of the stretcher block and is characterized by a flat portion having a plane parallel to the plane of the bottom surface edge portions and co-planar with the first portion top surface. The flat portion is disposed intermediate a pair of parallelly extending rectangular edge portions, the top surfaces of which form upwardly converging surfaces of truncated triangular cross-sectional configuration. The rectangular edge portions terminate at a shoulder formed between the first portion and the second portion. Inside sections of the top surface edge portions are configured to matingly and adjustably abut respective outside surfaces of the bottom surface recess of a block in an adjacent stacked row.

The end surface of the second portion is of identical configuration as the first end wall of the stretcher block and is further characterized by a recess having a planar portion disposed intermediate a pair of inwardly converging surfaces. The planar portion has a plane perpendicular to the plane of the top surface flat portion. The first end wall recess is further disposed intermediate a pair of co-planar, parallelly disposed laterally extending generally parallelepiped end portions having a plane perpendicular to the top surface flat portion.

The stretcher blocks of the present invention are further provided with internal cores in order to reduce the weight of each block. A web is formed between the front and rear panels and defines a pair of cores formed interiorly of the block. The cores further provide a means by which vertical reinforcing rods can be inserted in a structure formed of the blocks. Further, the blocks are designed to receive horizontally disposed reinforcing rods in order to provide lateral stability for the completed block structure assembly as further described hereinbelow. In similar fashion, the corner blocks are provided with internal cores, a web being formed between the first portion and the second portion and defining a first core formed in the first portion and a second core formed in the second portion.

BACKGROUND AND OBJECTS OF THE INVENTION

Applicant is aware of many commercially available concrete blocks for the construction of walls and the like. In reviewing the commercially available art he has not found any block which incorporated the advantages and alignment abilities as described herein.

A review of the patented art reveals that it is known to provide dry stackable concrete blocks for use in the construction of walls. In particular, it is known to provide a means for interlocking adjacent blocks as well as adjacent courses.

Commonly assigned U.S. Pat. No. 5,623,797 to Gravier et al. shows an interlocking stackable block structure wherein the top surface of each of the blocks has a pair of parallelly disposed upwardly protruding laterally extending ridge projections which mate and interlock with projections formed on the bottom surface of the block. Additionally, a post block is shown with recesses for lockingly receiving fence blocks therein.

Block structures having interlocking features are further disclosed in U.S. Pat. No. 3,962,842 to Wilhelm, U.S. Pat. No. 4,956,958 to Caroti, U.S. Pat. No. 4,124,961 to Habegger, U.S. Pat. No. 4,426,815 to Brown, U.S. Pat. No. 2,994,162 to Frantz, U.S. Pat. No. 3,534,518 to Zagray, U.S. Pat. No. 3,905,170 to Huettemann, U.S. Pat. No. 5,365,714 to Potvin, U.S. Pat. No. 5,031,376 to Bender et al., and U.S. Pat. No. 3,116,570 to Torricelli.

None of these patents provide a block structure or block stacking system having the lateral and transverse alignment capabilities of the block structure of the present invention.

It is therefore an object of the applicant's invention to provide a concrete block structure for the construction of walls which provides for transverse alignment of a dry stacked wall.

It is a further object of the applicant's invention to provide a concrete block structure for the construction of walls which provides for lateral alignment of the blocks in the wall.

It is a further object of the applicant's invention to provide a concrete block structure for the construction of walls which provides for vertical and horizontal reinforcement of the wall.

It is a further object of the applicant's invention to provide a concrete block structure for the construction of walls which includes a block structure specific to corner installation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 5:
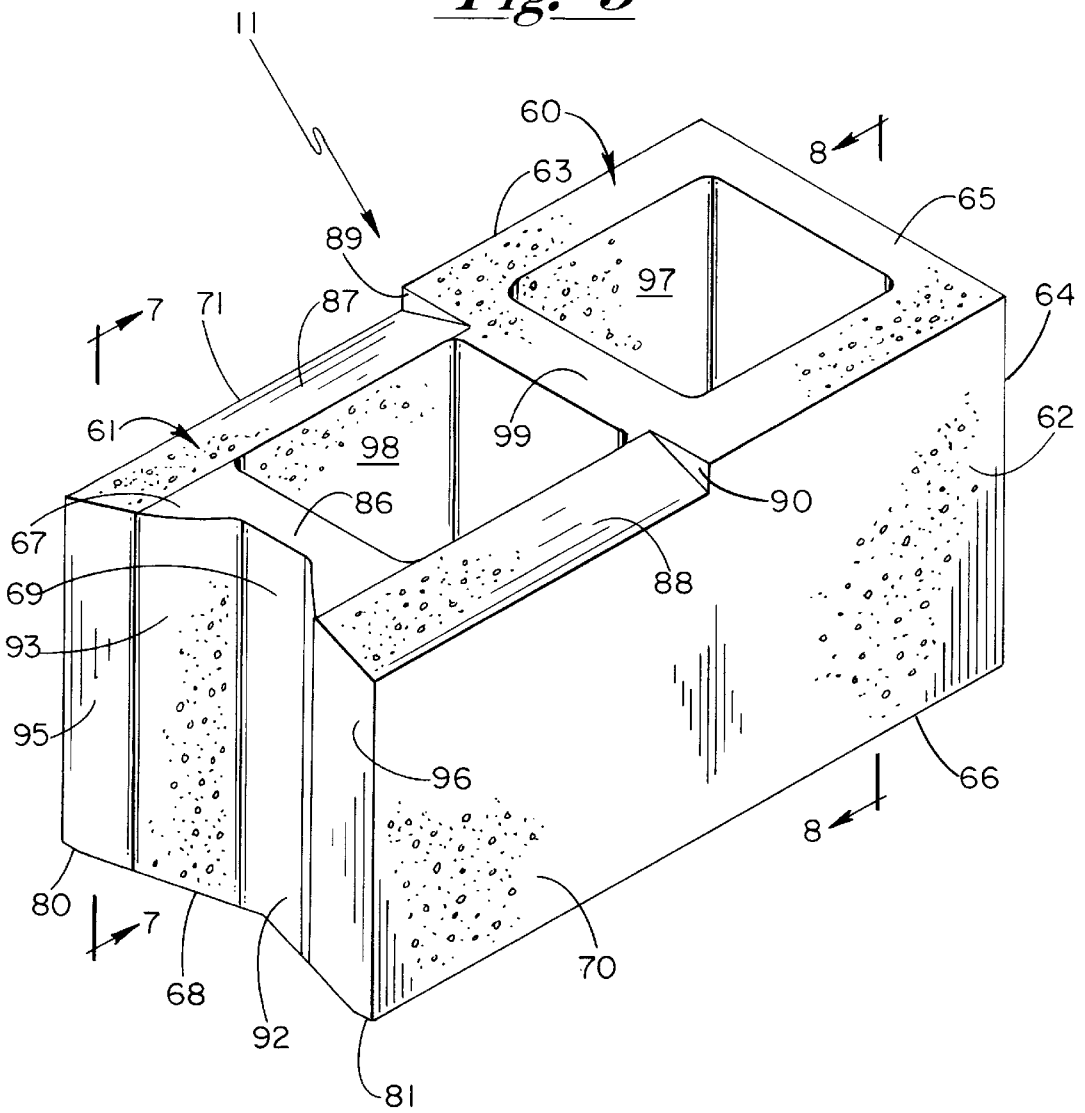
FIG. 5 is a perspective view of the corner block of the present invention.
Figure 6:
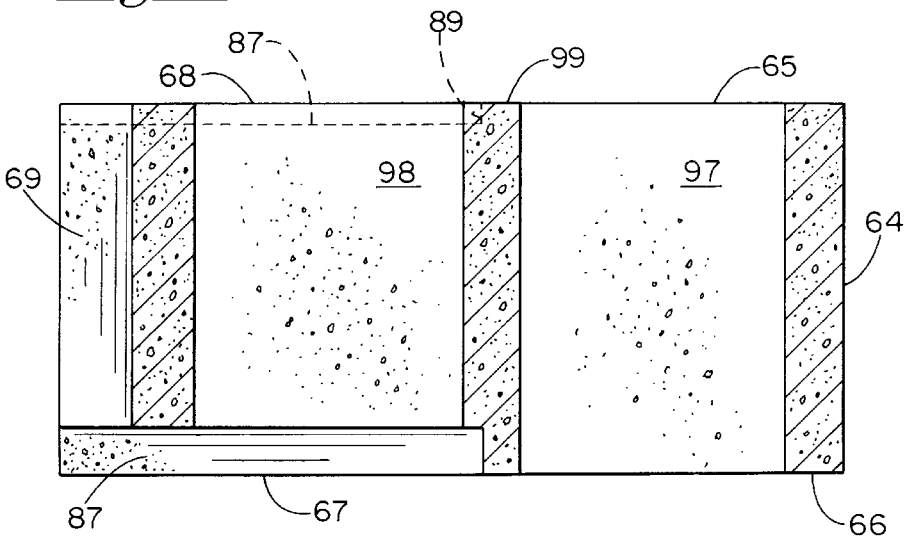
FIG. 6 is a vertical sectional view taken along the centeral axis of the corner block.
Figure 7:
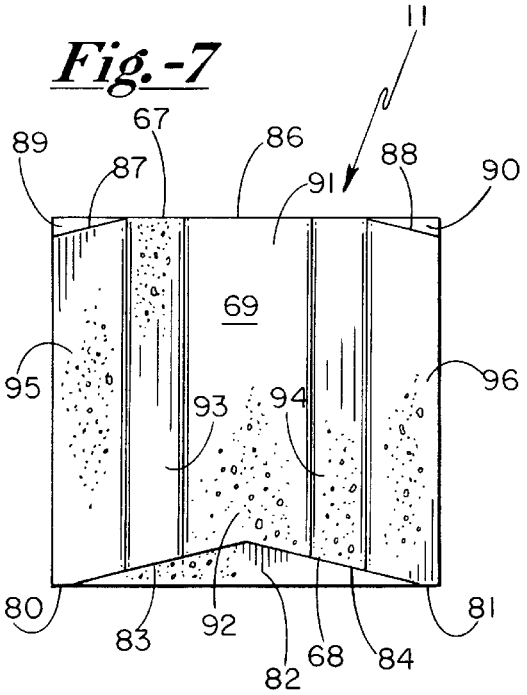
FIG. 7 is an end elevation view of the corner block showing the second portion end surface.
Figure 8:
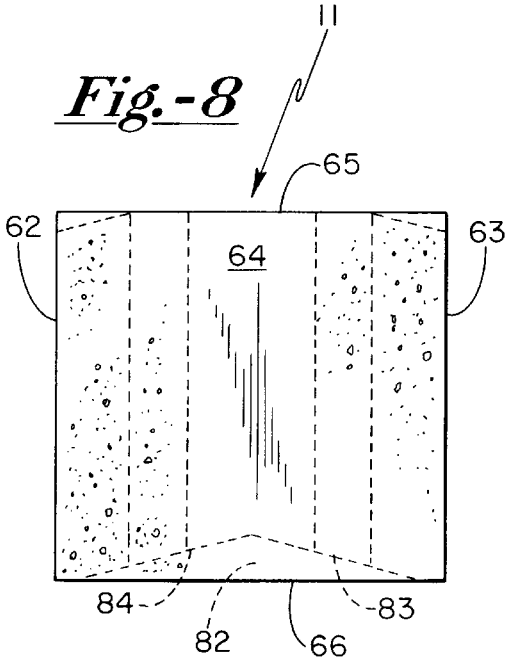
FIG. 8 is an end elevation view of the corner block showing the end surface of the first portion.
Figure 9:
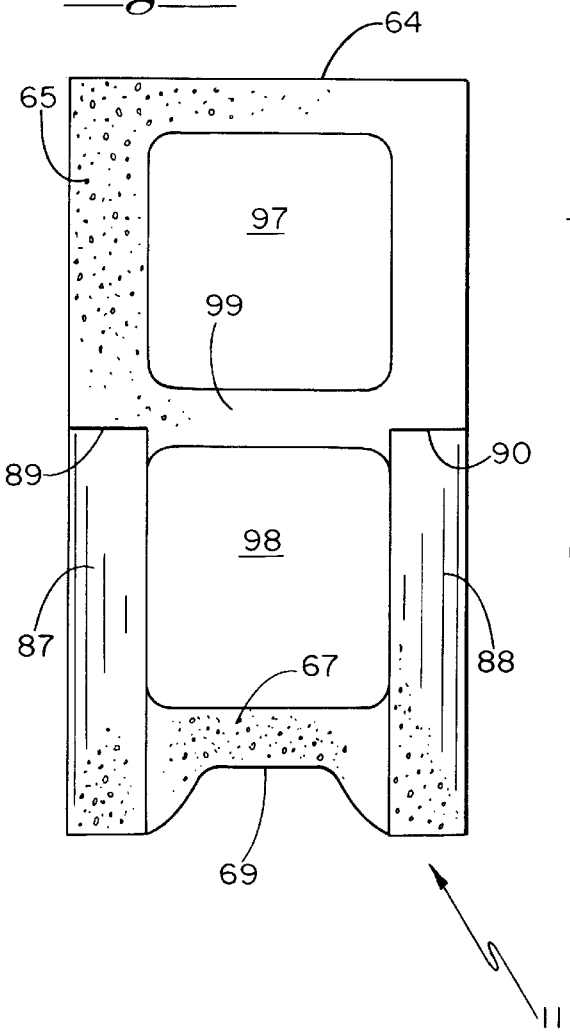
FIG. 9 is a top plan view of the corner block.
Figure 10:
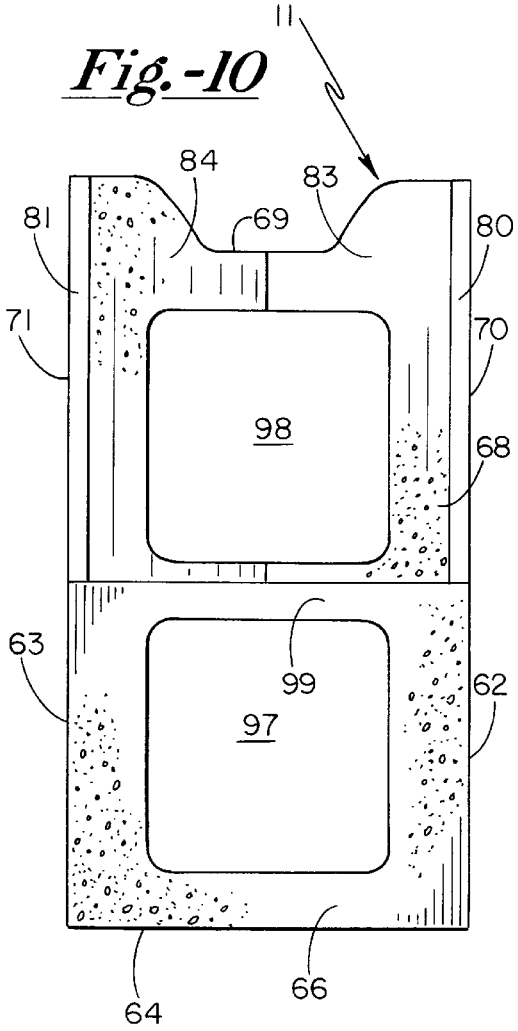
FIG. 10 is a bottom plan view of the corner block.

In accordance with the accompanying drawings the concrete block structure as the basis of the concrete block stacking system of the applicant's invention is generally designated 10. A modified form of the block structure particularly adapted for corner installations is generally designated 11 as illustrated in FIG. 5. This form will be described after the description of the first block structure 10 hereinafter referred to as the stretcher block.

Figure 11:
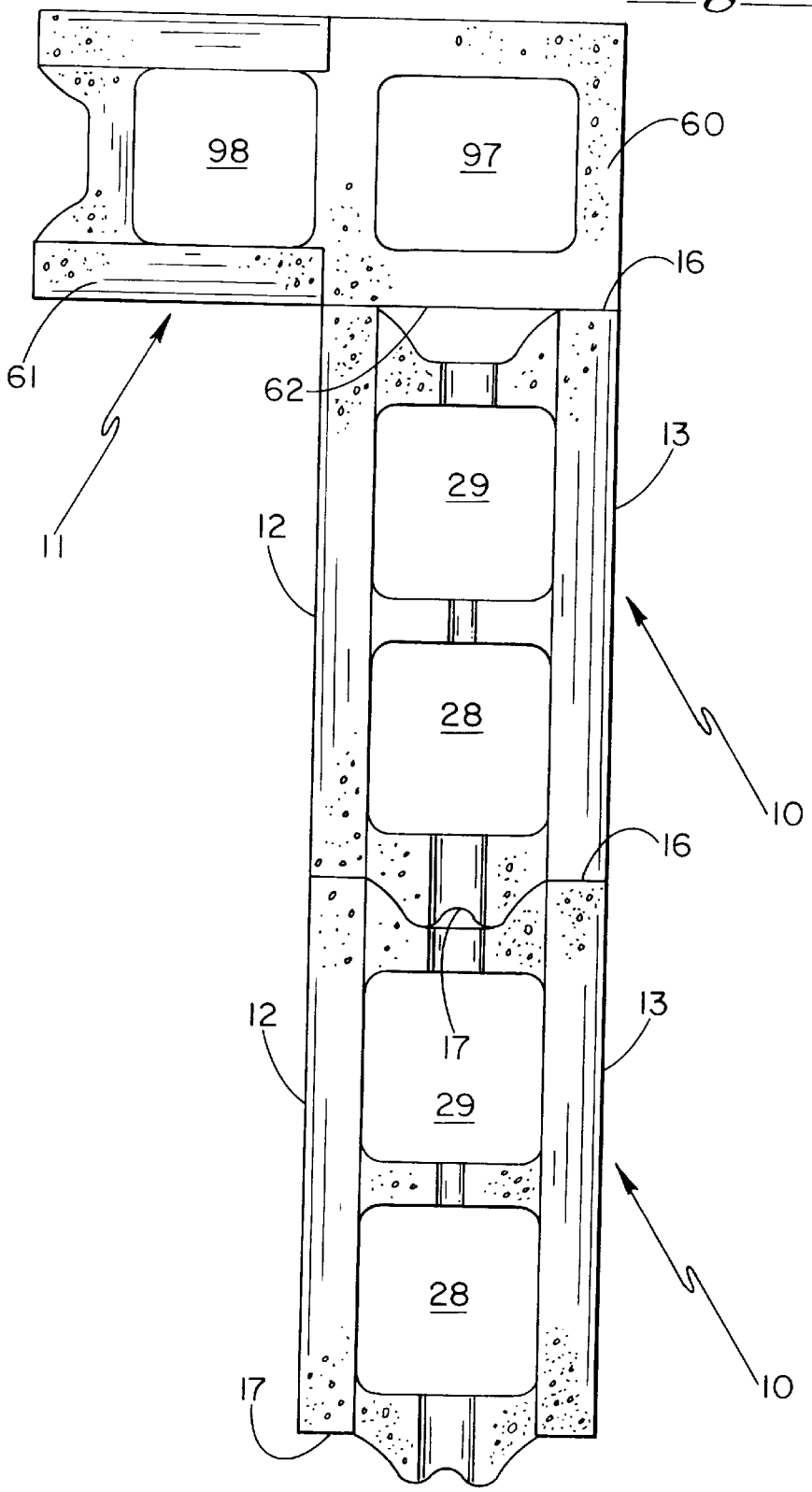
FIG. 11 is a top plan view of the block stacking system including stretcher blocks and a corner block.

A typical wall section as constructed with a plurality of stretcher blocks 10 and a corner block 11 is shown in FIG. 11. The wall section shows the interlocking arrangement of the stretcher blocks 10 and more particularly shows the mating arrangement of the first and second end wall surfaces of the stretcher block 10. The wall section further illustrates the use of the corner block 11 in forming a 90° corner in combination with the stretcher blocks 10.

The stretcher block 10 is of generally rectangular shape and of a predetermined height and length. The stretcher block 10 is shown including a pair of opposed rectangular front and rear panels 12 and 13 respectively, a top surface 14, a bottom surface 15, and a pair of opposed end wall surfaces 16 and 17.

Figure 3:
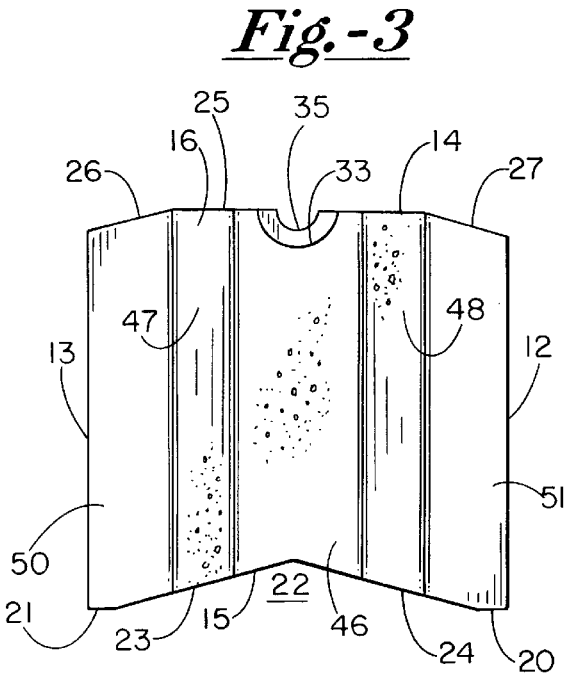
FIG. 3 is a side elevation view of the stretcher block.

With reference to FIG. 3 the bottom surface 15 includes a pair of co-planar, parallelly disposed laterally extending rectangular edge portions 20 and 21. The edge portions 20 and 21 of the block structures of a first course of blocks are configured to provide support to a wall structure as further described hereinafter. Shown defined between the edge portions 20 and 21 is a recess 22 which forms upwardly converging surfaces 23 and 24 of triangular cross-sectional configuration.

Figure 2:
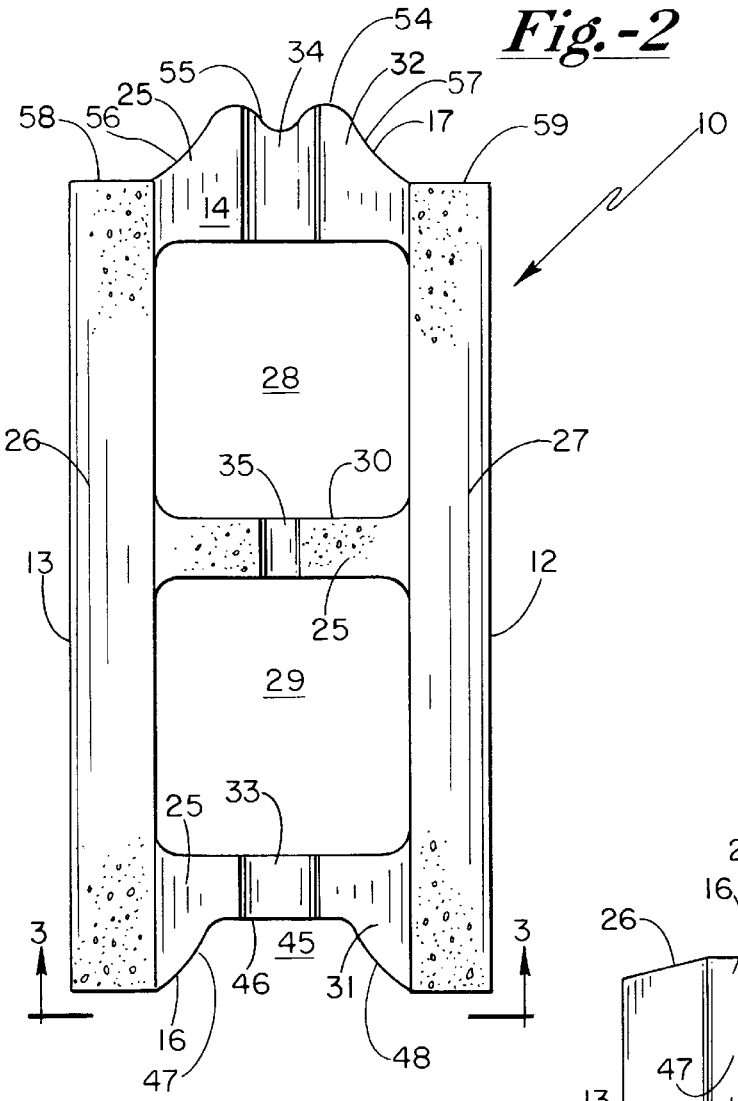
FIG. 2 is a top plan view of the stretcher block.

As illustrated in FIGS. 2 and 3, the top surface 14 includes a flat portion 25 having a plane disposed parallel to the plane of the bottom surface edge portions 20 and 21. A pair of internal cores 28 and 29 are shown extending through the stretcher block 10 from the top surface 14 to the bottom surface 15. A web 30 divides core 28 from core 29 and the cores 28 and 29 further define webs 31 and 32 coincident with the end walls 16 and 17 respectively.

With particular reference to FIG. 2, webs 31 and 32 are shown having notches 33 and 34 formed on respective upper portions thereof and extending therealong normal to the longitudinal axis of the webs. Notches 33 and 34 are disposed at a midpoint of the webs 31 and 34 and further have a generally semi-circular cross sectional configuration adapted to receive a horizontally disposed reinforcing bar as further described hereinafter.

A notch 35 is shown formed on a mid-point of an upper portion of web 30. Notch 35 is of semi-circular cross sectional configuration and has a smaller radius than that of notches 33 and 34. Thus, the smaller radiused notch 35 functions as a rebar support pad, while the larger radiused notches are provided to allow concrete to engage the rebar at the ends of the block structure.

Figure 4:
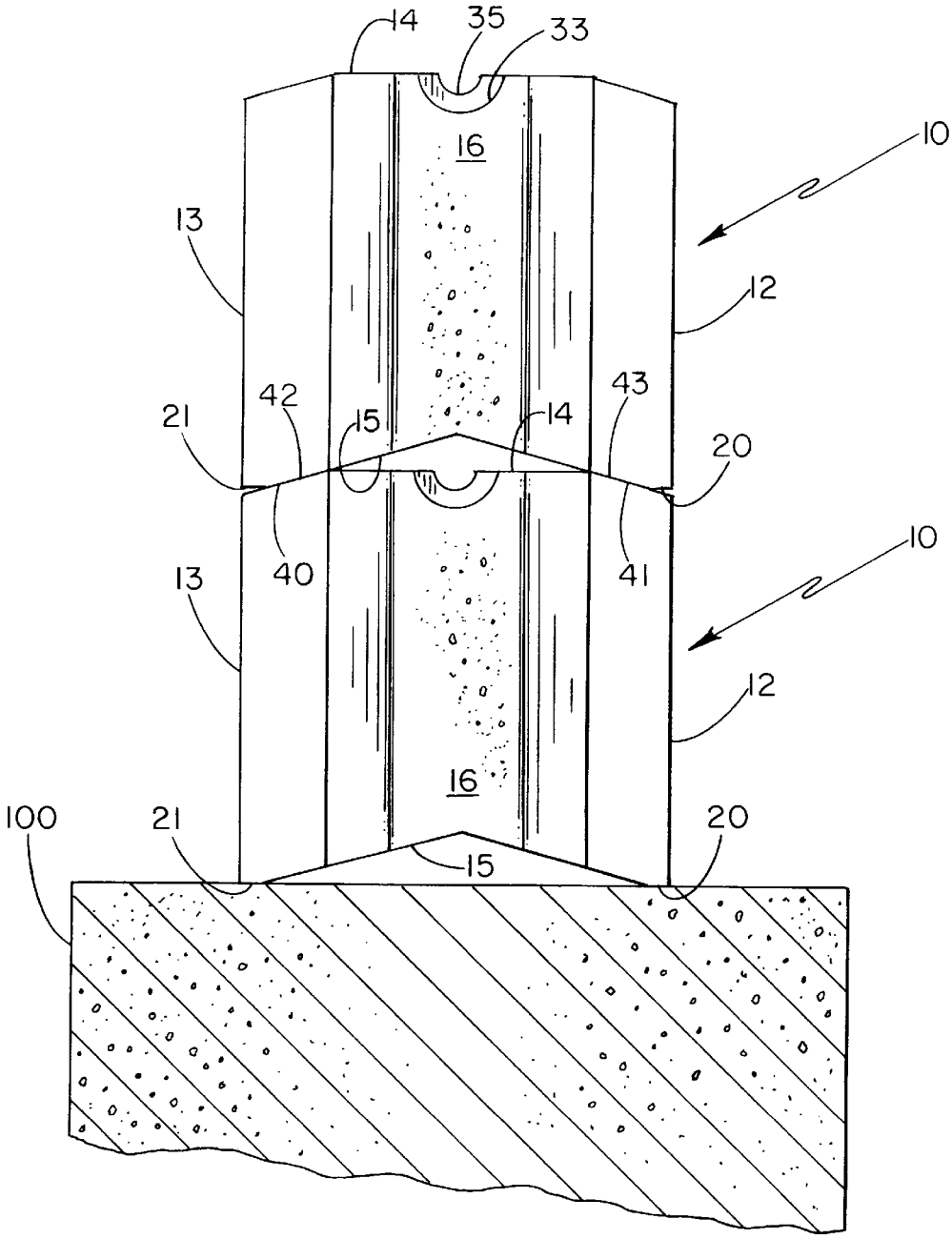
FIG. 4 is a side elevation view showing a pair of stretcher blocks dry stacked upon a footing.

The flat portion 25 is shown disposed between a pair of parallelly extending rectangular edge portions 26 and 27, the top surfaces of which form upwardly converging surfaces of truncated triangular cross-sectional configuration. With particular reference to FIG. 4, a pair of stretcher blocks 10 are shown in stacked arrangement wherein inside sections 40 and 41 of the top surface edge portions 26 (shown in FIG. 3) and 27 are shown in mating and abutting relationship with respective outside sections 42 and 43 of the bottom surface recess surfaces 23 and 24 (see also FIG. 3). The angle of the surfaces 23 and 24 with respect to the plane of the edge portions 21 and 20 is such that stacked block structures 10 are transversely alignable with respect to one another, the interface between the inside sections 40 and 41 of the lower block and the outside sections 42 and 43 of the upper block providing a ball and socket joint. The stacked block structures are further laterally alignable along the interface. The mating and abutting surfaces such as the top surface edge portions 26 and 27 are illustrated in a linear arrangement. Radiused surfaces may be successfully employed as well.

Figure 1:
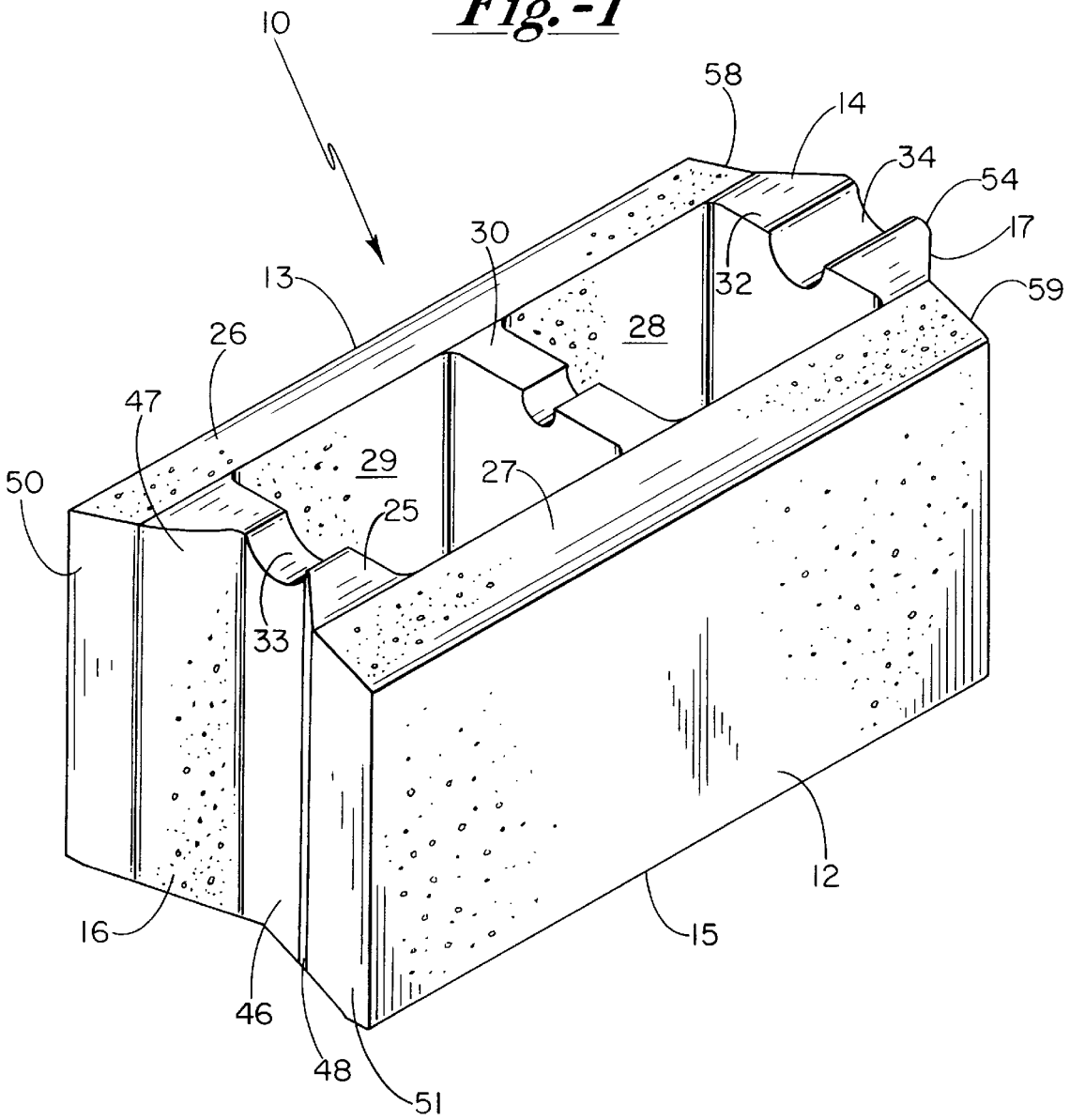
FIG. 1 is a perspective view of the stretcher block structure of the present invention.

With reference to FIGS. 2 and 3, a stretcher block structure first end wall surface 16 is shown including a recess 45 having a planar portion 46 disposed intermediate a pair of inwardly converging surfaces 47 and 48. The planar portion 46 has a plane perpendicular to the plane of the top surface flat portion 25. The recess 45 is shown formed intermediate a pair of co-planar, parallelly disposed laterally extending generally parallelepiped edge portions 50 and 51. First end wall edge portions 50 and 51 are of equal width as top surface edge portions 26 and 27 and have a plane perpendicular to the top surface flat portion 25 as best illustrated in FIG. 1.

The second end wall surface 17 is shown in FIG. 2 and includes a protrusion 54 having a concave portion of generally semi-circular cross section 55 disposed intermediate a pair of outwardly converging surfaces 56 and 57. The protrusion 54 is disposed intermediate a pair of co-planar, parallelly disposed laterally extending rectangular end portions 58 and 59. End portions 58 and 59 are disposed in a plane perpendicular to the top surface flat portion 25. The outwardly converging surfaces 56 and 57 are configured for mating abutment to the inwardly converging surfaces 47 and 48 of the first end wall 16. This arrangement provides for lateral alignment and interlocking of adjoining block structures.

With reference to FIGS. 5–10, the corner block 11 of the present invention is shown including a first portion 60 and a second portion 61. The first portion 60 is of parallelepiped construction having a pair of rectangular side surfaces 62 and 63, a rectangular end surface 64, a rectangular top surface 65, and a rectangular bottom surface 66. The second portion 61 is shown integrally formed to the first portion 60 and includes a top surface 67, a bottom surface 68, an end surface 69, and a pair of rectangular side surfaces 70 and 71. The side surfaces of the second portion 61 are co-planar with the side surfaces of the first portion 60.

As illustrated in FIGS. 5–10, the second portion 61 of the corner block 11 is of similar configuration as the stretcher block 10. In particular, the second portion bottom surface 68 is of similar configuration as the bottom surface 15 of the stretcher block 10 and is characterized by a pair of co-planar, parallelly disposed laterally extending rectangular edge portions 80 and 81 defining a recess 82 therebetween. The bottom surface recess 82 forms upwardly converging surfaces 83 and 84 of triangular cross-sectional configuration. The edge portions 80 and 81 are co-planar with the first portion bottom surface 66 while the upwardly converging surfaces 83 and 84 extend along the length of the second portion bottom surface 68 and terminate at a shoulder 85 formed at the boundary between the first and second portions 60 and 61.

The second portion top surface 67 is of similar configuration as the stretcher block top surface 14 and is characterized by a flat portion 86 having a plane parallel to the plane of the bottom surface edge portions 80 and 81 and co-planar with the first portion top surface 65. The flat portion 86 is disposed intermediate a pair of parallelly extending rectangular edge portions 87 and 88 which form upwardly converging surfaces of truncated triangular cross-sectional configuration. The edge portions 87 and 88 terminate at shoulders 89 and 90 respectively formed at the boundary between the first and second portions 60 and 61.

Inside sections of the second portion edge portions 87 and 88 are configured to matingly and adjustably abut respective outside surfaces of the bottom surface recess 22 (see FIG. 3) of a block in an adjacent stacked row providing the ball and socket joint as described with respect to the stretcher block stacked arrangement.

The second portion end surface 69 is of identical configuration as the first end wall surface 16 of the stretcher block 10 and is further characterized by a recess 91 having a planar portion 92 disposed intermediate a pair of inwardly converging surfaces 93 and 94. The planar portion 92 has a plane perpendicular to the plane of the top surface flat portion 86. The recess 91 is further disposed intermediate a pair of co-planar, parallelly disposed laterally extending generally parallelepiped end portions 95 and 96 having a plane perpendicular to the top surface flat portion 86.

A web 99 is shown formed between the first portion 60 and the second portion 61 and defines a first core 97 formed in the first portion 60 and a second core 98 formed in the second portion 61.

As to a further discussion of the manner of usage and operation of the present invention, the same should be apparent from the above description. Accordingly, no further discussion relating to the manner of usage and operation will be provided.

With reference to FIG. 4, a stacked arrangement of stretcher blocks 10 is illustrated. The edge portions 20 and 21 provide a weight-bearing surface for the wall which is shown constructed upon a footing 100. The interface between sections 40 and 42 and sections 41 and 43 provide the ball and socket joint of the present invention.

The use of the corner block 11 as well as the interlocking of adjacent stretcher blocks 10 is illustrated in FIG. 11. As shown, the corner block 11 is used to provide a right angle corner. The first end wall surface 16 of the stretcher block 10 adjacent to the corner block 11 is shown abutted to the side wall 62 of the corner block 11. In this configuration, the corner block second portion 61 provides a means for lateral and transverse alignment of the next stretcher block in the next course of the wall. To continue the construction of the wall a second corner block is positioned over the first corner block and oriented 90° with respect to the first corner block in such manner that the first portion 60 of the upper corner block is positioned over the first portion 60 of the lower block. The first portions 60 are further bonded together using construction grade adhesive to provide a leveling joint in two directions.

Adjacent stretcher blocks 10 are shown interlockably positioned in such manner that the first end wall surface 16 is matingly and abuttably engageable to the second end wall surface 17. If desired, adjacent stretcher blocks may be positioned in non-abutting relationship to provide lateral alignment to the wall.

To strengthen the wall, vertically disposed reinforcing bars may be advantageously positioned within the cores 28 and 29 formed in the stretcher blocks 10 and the cores 97 and 98 formed in the corner blocks 11 and filled with grout.

Horizontally disposed reinforcing rods may be positioned between courses and received in notches 33–35.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents It may be resorted to, falling within the scope of the invention.

What is claimed is:

1. A concrete block stacking system for dry stacking of concrete reinforced walls comprising:

a stretcher block having a pair of opposed front and rear panels, a top and bottom surface, and opposed first and second end wall surfaces;

said bottom surface having a pair of co-planar, parallelly disposed laterally extending rectangular edge portions delineating a recess therebetween, said recess being formed and defined by upwardly converging surface portions of triangular cross-sectional configuration extending from said front and rear panels respectively and intersecting at a common central apex;

said top surface having a generally flat central portion lying along and above a plane parallel to the plane of the top edges of said front and rear surfaces, said flat central portion being disposed intermediate a pair of laterally disposed parallelly extending rectangular edge portions the top surfaces of which intersect said front and rear panels and said flat central panel to form upwardly converging surfaces of truncated triangular cross-sectional configuration, an inside portion of said top surfaces being matingly abuttable to said upwardly converging bottom surface portions of a neighboring stretcher block in an adjacent upper stacked row;

said first end wall surface having a first end wall recess with a planar portion disposed intermediate a pair of inwardly converging inwardly extending end wall surface segments, said planar portion having its outer surface disposed along a plane perpendicular to the plane of said top surface flat portion, said first end wall recess further being disposed intermediate a pair of co-planar, parallelly disposed laterally extending generally parallelepiped outer end wall surface segments each of which are disposed along a plane perpendicular to said top surface flat portion; and said second end wall surface having a central protrusion formed thereon, said protrusion being of a configuration matingly abuttable to and adapted to be accommodated within said first end wall recess.

2. The concrete block stacking system of claim 1 further comprising a corner block, said corner block having a first portion of parallelepiped construction and an integral second portion of similar configuration to said stretcher block.

* * * * *